United States Patent [19]

Gleason

[11] 4,109,910

[45] Aug. 29, 1978

[54] WEIGHTED TENNIS NET SUPPORT POST

[76] Inventor: Theodore J. Gleason, 2 Sanders Pl., Pompton Plains, N.J. 07444

[21] Appl. No.: 705,347

[22] Filed: Jul. 14, 1976

[51] Int. Cl.[2] ..... A63B 71/02

[52] U.S. Cl. ..... 273/29 BB; 248/158; 273/DIG. 25

[58] Field of Search ..... 273/26 R, 26 A, 29 A, 273/29 B, 29 BB, 1.5 R, DIG. 25; 272/76; 108/25; 248/121, 519, 173, 511, 156, 158; D9/60, 61, 62, 72

[56] References Cited

U.S. PATENT DOCUMENTS

| | | | |
|---|---|---|---|
| 47,355 | 5/1915 | Coane | D9/61 |
| 1,444,344 | 2/1923 | Gourley | 273/29 BD |
| 1,627,652 | 5/1927 | Kornicker et al. | 248/156 |
| 1,679,675 | 8/1928 | Lujan | 248/121 |
| 3,119,588 | 1/1964 | Keats | 248/519 X |
| 3,841,631 | 10/1974 | Dolan | 273/1.5 R |
| 3,966,205 | 6/1976 | Schain et al. | 273/29 A |

*Primary Examiner*—Richard C. Pinkham
*Assistant Examiner*—T. Brown
*Attorney, Agent, or Firm*—Thomas N. Neiman

[57] ABSTRACT

The apparatus comprises a base and an upright which upright is used for supporting an obstacle for a missile. The apparatus is especially useful for supporting a tennis net, but does not need to be staked into the ground, neither does it need to be formed of ponderously-weighty material. According to an embodiment of the invention, the base is hollow, the same defining a reservoir therewithin, and the reservoir is fillable with fluent material, such as water or sand, to weight the apparatus — that it might support the missile obstacle (net, or whatever) with sufficient rigidity. Too, then, the reservoir is ventable — to discharge the fluent material — whereby the apparatus can be carried and stored without presenting a weight or storage problem.

3 Claims, 4 Drawing Figures

WEIGHTED TENNIS NET SUPPORT POST

This invention pertains to amusements and games, and in particular to apparatus for use in those games which use a missile, such as a ball, shuttlecock, and the like, and an obstacle for the missile — an obstacle past which the missile is intended to go, or over which the missile must loft, such as a net, hoop, and the like, failing which the missile rebounds from the obstcle.

The game of tennis, particularly, has enjoyed a notable rise in popularity. Yet, tennis is a game which requires many hours of practice before an appreciable degree of proficiency therein is to be achieved. For the novice, it would require a considerable investment to support the sport, the fees at tennis courts being burdensome. Freely available municipal courts are too few, and invariably crowded. So also, for the tennis player who is beyond the novice stage, there are but limited facilities available for the practice of the game. Tennis, badmington, and games of this type, are not considered capable of practice and play indoors, or on camping trips, and the like, principally due to the prescribed size of the court and the necessity for rigidily staked or embedded upright supports for the net.

As a consequence of all the foregoing, tennis, badmington, even basketball, can only rarely be enjoyed, and then in prescribed places and/or with prescribed equipment. Thus, those who would find pleasure in these sports, were the latter more capable of play in more universal circumstances, have suffered a neglect.

It is an object of this invention to obviate the aforenoted limitations in the practice and play of the games of the type referenced. That is, it is an object of this invention to set forth facile apparatus for use in tennis, badmington, basketball, and the like. My invention comprises means, for instance, which will support a tennis net but which does not have to be staked to or embedded in the ground — a means which does not include ponderously weighty uprights. Particularly, it is an object of this invention to set forth apparatus for use in a game employing a missile and an obstacle therefor, comprising an elongate element, and a mounting base coupled to said elongate element; said mounting base having a first functional condition, in which said base bears upon a surface, upon said base being disposed thereon, with a first given force, and a second functional condition in which said base bears upon such a surface with a second force greater than said given force; and wherein said base includes means formed therein which is selectively adaptive to produce said first and second forces.

Further objects of this invention, as well as the novel features thereof, will become more apparent by reference to the following description taken in conjunction with the accompanying figures, in which.

Figure 1:
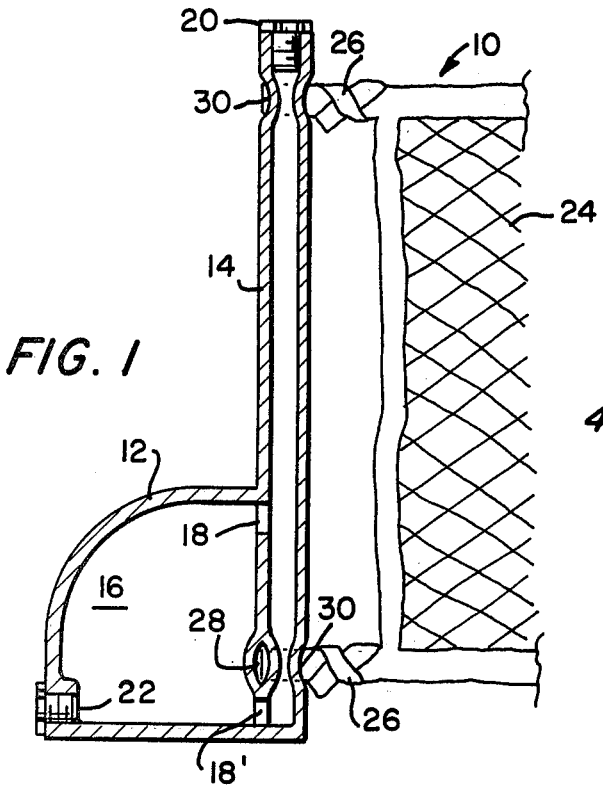
FIG. 1 is a cross-sectional view, in elevation, of an embodiment of the invention, the cross-section being taken along section 1—1 of FIG. 2.
Figure 2:
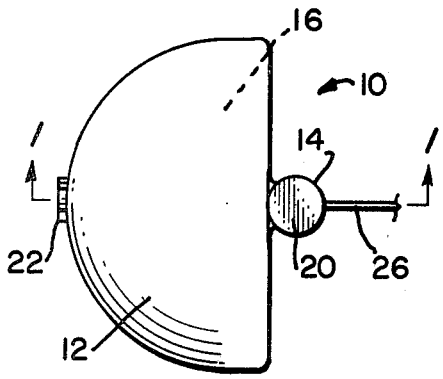
FIG. 2 is a plan view of the embodiment of FIG. 1.

In the first embodiment of the invention, as depicted in FIGS. 1 and 2, the apparatus 10 comprises a base 12 and an upright 14 wherein both the base and upright are hollow. The void within the base 12 comprises a reservoir 16 in which to confine a fluent material — such as water, sand, or the like. The hollow interior of the upright 14 communicates with the reservoir by means of ports 18 and 18'. The uppermost end of the upright 14 threadedly receives a filler plug 20. Thus, by unthreading the plug, both the base and upright can be filled with the selected fluent material. In line with a lowermost area of the reservoir 16, a second plug 22 is threadedly fixed in a wall of the base 12. Plug 22 is unthreaded and withdrawn to evacuate the base and upright, when it is desired to terminate game play and remove and store the apparatus 10.

Simply by filling the apparatus 10 with weighting fluent material, then, the apparatus can be adapted for play-use condition, and then by venting the fluent material, the apparatus can be adapted for a light-carry/storage condition. Clearly, the two diverse conditions of the apparatus 10 are effected by either weighting the base 12 through charging the same with fluent material — preferably water — or by evacuating the fluent material therefrom. Patently, in the former condition, the base will bear with a reasonably heavy force upon the surfce whereat game play would be pursued, and in the latter condition the base will bear most lightly. Especially is the latter condition so, as the apparatus 10 is formed of light, thin-walled plastic. Accordingly, upon being emptied of the fluent material, the apparatus 10 can be picked up, carried, and stored even by a small child.

As will be evident, it is intended that a pair of apparatuses be employed to support the missile obstacle, the net 24 shown tied by webbing 26 to the upright 14. Toward the lowermost portion of the base 12 and upright 14, and therebetween, is formed a throughgoing void 28. This void, and the annular recesses 30 formed in the upright 14 at either ends of the latter, are used to accomodate the webbing 26 that the net 24 can be secured.

Figure 3:
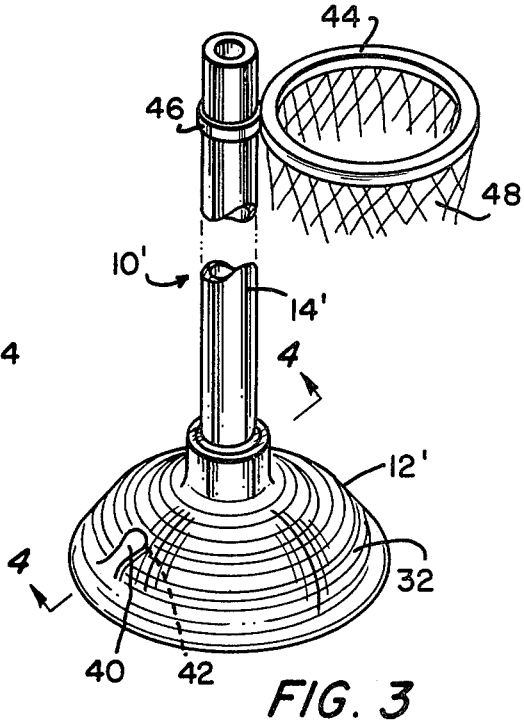
FIG. 3 is an isometric projection of an alternate embodiment of the invention.
Figure 4:
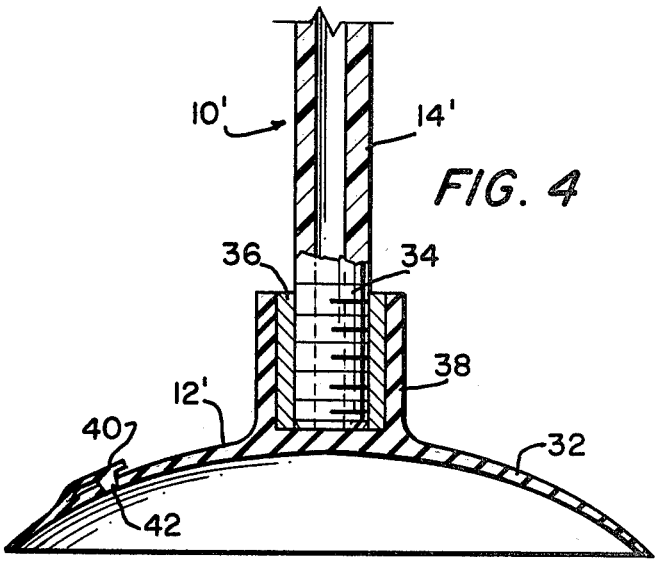
FIG. 4 is a cross-sectional view of the FIG. 3 embodiment, taken along section 4—4 of FIG. 3, the view being in larger scale than that of FIG. 3.

FIGS. 3 and 4 illustrate an alternative embodiment of the apparatus 10' where, however, while the upright 14' is formed of plastic material, the base 12' — the same being a suction cup 32 — is formed of elastomeric material. At the lowermost end 34 thereof, the upright 14' is threaded. This threaded end 34 threadedly engages an internally threaded shell 36 which is frictionally clasped by and secured in the cup-shaped head 38 of the base 12'.

In a manner well known, the suction cup 32 is depressed to evacuate air from thereunder and to create a relative vacuum under base 12'. Consequently, atmospheric pressure bears heavily upon the uppermost surface of the bell-shaped disc of the suction cup 32, and this pressure forces the suction cup to bear heavily upon the underlying surface whereat the vacuum has been created. This embodiment, then, of the apparatus 10' is usable where there is a relatively smooth and air-sealable surface; an asphalt-tile basement floor would be exemplary of such a surface.

The suction cup 32 has, integral therewith, a vent plug 40 which forms an interference fit in a vent orifice 42. To release the suction cup 32 from the surface to which it shall have been caused to bear forcefully, it is only necessary to remove the plug 40 from the orifice. If it is desired to store the upright 14' and the base separately, the end 34 of the upright 14' is simply unthreaded from the shell 36.

As noted priorly, the apparatus 10 or 10' lend themselves to use in play of tennis or badmington — or basketball. With reference to FIG. 3, it can be seen that upright 14' carries the well-known basketball obstacle, a hoop 44 — i.e., the ring or annulus over which the basketball must pass. The hoop 44 has a loop 46 fixed to one edge. The loop has a diameter therewithin which is only slightly larger than the outside diameter of the upright 14'. Also, the loop 46 is slightly inclined, upwardly, some 15° or 20° of arc, relative to the plane in which lies the hoop 44. Thus, by tilting the loop 46 until it is parallel with the floor, and sliding it over the end of the upright 14', it will receive the latter. Then, by allowing the hoop 44 to bring its off-center weight to bear, the loop will assume a canted and locked position on the upright 14'. It may be sufficient only to use the hoop 44; alternatively, a hoop 44 with a pendant basketball netting 48 (as shown in FIG. 3) can be employed.

The facile universality of my apparatus 10 and 10' is such that, as will be quite evident, game learning, practice and play can be pursued in a garage, in a basement, in a large game room, on a driveway, a patio, a campsite, etc.

The manner in which my inventive apparatus will be used, and where, is quite at the option of the user. However, ancillary to the novel apparatus itself, I propose the playing of that which I call "short tennis". In this, I suggest the lay out of a small court: approximately 6 feet by 12 feet, in which a net, some 5 or 6 inches deep is used. The "short tennis" is played by one opponent standing outside the 12 foot boundary to serve: once bouncing a ball and hitting it over the net to his opposite number. The latter will, in turn, bounce the ball within the court and drive it over the net again, and so on. The play may be carried on with racquets, paddles, or with the hands. Much of the learning of tennis involves the practice of following (i.e., keeping an eye on) the ball. Thus, particularly in this, a great deal of benefit will be derived in practicing and playing "short tennis" with the use of hands only.

While I have described my invention in connection with specific embodiments thereof, and set forth typical uses therefor, it is to be clearly understood that this is done only by way of example, and not as a limitation to the scope of my invention as set forth in the objects thereof and in the appended claims. For instance, the apparatus 10 or 10' itself is usable as an obstacle, without any means coupled thereto. Either of the embodiments, or others which will come to mind through the teaching of my disclosure, are readily usable as "obstacles" to set out an area of demarcation along a roadside whereat road repair or rebuilding is to be pursued — the obstacles being used to ward off traffic. Too, the embodiments depicted, or others proceeding from my inventive concept, are usable to line and protect sensitive plots of ground: i.e., freshly seeded lawns, freshly poured concrete, etc. In addition, string — with or without pendant strips of cloth — can run from successively placed "obstacles". Either of the depicted embodiments can be used to "carry" light plastic receivers for ash trays, drinking glasses, etc., for use on porches, patios, and the like. Thus, the scope of my invention is such as to embrace all the uses thereof, particularly as the using embodiments thereof fall within the ambit of my claims.

I claim:

1. Apparatus, for use in a game employing a missile and an obstacle therefor, comprising:

a mounting base having a flat bottom surface;

said mounting base comprising a hollow container defining a fluent material reservoir therewithin; and upright means for supporting a missile obstacle;

said upright means being integral with said mounting base, and extending from said mounting base at an angle normal to said bottom surface;

said upright means having first and second opposite sides; and wherein said mounting base is integrally fixed to said upright means at only one of said first and second sides, to render the other of said sides unobsructed;

said upright means comprises an elongate, hollow element;

said hollow element opens into said hollow container to effect a communication of the interior of said hollow element with the interior of said hollow container;

said elongate, hollow element has inlet means for introducing fluent material thereinto to fill said hollow container and said elongate, hollow element with such fluent material;

said hollow container and said elongate, hollow element define an interface therebetween along said one side; and said hollow container and said elongate, hollow element have a walled void formed therebetween, at said one side, to facilitate an attachment thereat of a missile obstacle.

2. Apparatus, according to claim 1, wherein:

said hollow container has an aperture formed therein which opens onto a lowermost area of said fluent material reservoir with a replaceable plug in closure thereof for evacuating said reservoir of fluent material.

3. Apparatus, according to claim 1, wherein:

said elongate, hollow element has an annular recess formed therein to facilitate an attachment thereat of a missile obstacle.

* * * * *